US006098559A

United States Patent [19]

Hirose

[11] Patent Number: 6,098,559

[45] Date of Patent: Aug. 8, 2000

[54] STITCH DATA COMPENSATION DEVICE

[75] Inventor: Hirokazu Hirose, Chiryu, Japan

[73] Assignee: Brother Kogyo Kabushiki Kaisha, Nagoya, Japan

[21] Appl. No.: 09/401,538

[22] Filed: Sep. 22, 1999

[30] Foreign Application Priority Data

Oct. 8, 1998 [JP] Japan ..... 10-286764

[51] Int. Cl.[7] ..... D05B 21/00; D05C 5/02

[52] U.S. Cl. ..... 112/475.19; 112/102.5; 700/138

[58] Field of Search ..... 112/475.19, 102.5, 112/470.06, 470.04; 700/138

[56] References Cited

U.S. PATENT DOCUMENTS

| | | | |
|---|---|---|---|
| 5,343,401 | 8/1994 | Goldberg et al. | 112/475.19 X |
| 5,778,807 | 7/1998 | Nishizawa et al. | 112/470.06 X |
| 5,960,731 | 10/1999 | Kubota | 112/470.04 |

FOREIGN PATENT DOCUMENTS 4-259484 9/1992 Japan .

*Primary Examiner*—Peter Nerbun

*Attorney, Agent, or Firm*—Oliff & Berridge, PLC

[57] ABSTRACT

When a stitch data compensation device detects that a control code which indicates a movement of a work cloth is added to the current and next stitch data, it corrects an X-direction movement amount and a Y-direction movement amount for the current stitch data according to an angle between a stitch to be formed based on the current stitch data and a consecutive stitch to be formed based on the next stitch data. When sewing is made on a sewing machine using the stitch data corrected by the stitch data compensation device, the shrinkage of the work cloth that would occur due to each stitch sewn thereinto can be prevented, which will result in preventing an uneven finished pattern, such as a gap in a satin pattern, a jagged fill pattern, and stitches to be made on the return when the sewing direction is reversed deviating from the ones already made on the go when running stitching is selected, assuring fine stitches will be formed on the work cloth.

19 Claims, 7 Drawing Sheets

STITCH DATA COMPENSATION DEVICE

BACKGROUND OF THE INVENTION

1. Field of Invention

The invention relates to a stitch data compensation device which corrects a relative amount of X- or Y-axis movement of a work cloth with regard to a needle.

2. Description of Related Art

Some sewing machines use an actuator that is controlled based on an amount of sewing data movement in the X- or Y-direction, thereby moving a work cloth in the X- or Y-direction. In this case, when the work cloth is moved in the opposite direction, backlash occurs in the transmission mechanism which transmits a driving force of the actuator to the work cloth, and an actual movement amount of the work cloth is insufficient for the sewing data. Therefore, when the work cloth is moved in the opposite direction, the movement amount in the X- or Y-direction needs to be corrected in order to cover the insufficiency.

To cope with the insufficiency of the mechanical movement that is generated when the work cloth is moved in the opposite direction, a predetermined value is added to the sewing data. However, if the predetermined value to be added to the sewing data is greatly over the insufficiency, the finished sewing pattern may have a distorted shape. For example, when the shrinkage of the work cloth due to a thread tension during sewing can not be prevented, gaps can be seen in the finished satin pattern. In a fill pattern, stitches will be jagged because needle penetration points are not aligned. Moreover, when the running stitching is used and the direction of the running stitching is reversed, stitches to be made on the return may deviate from the ones already made in the original movement direction.

Japanese laid-open Patent Publication No. 4-259484 discloses a frame feed correction device for an embroidering machine, in which the frame feed correction data can be set for X- and Y-axes separately. According to this device, the feed amount can be corrected in consideration of not only the backlash in the transmission mechanism but also the shrinkage of the work cloth.

However, the shrinkage of the work cloth varies with the degree of the angle to be formed by successive two stitches. The correction device described in the Japanese laid-open Patent Publication No. 4-259484, is incapable of accounting for the shrinkage effect caused by the angle formed by successive stitches and to correct the stitch data to compensate for that effect. Namely, when the angle between stitches is smaller, the forces to be exerted on the stitches are combined into a large force, which can pull the work cloth greatly, and the resultant shrinkage will be great. On the contrary, when the angle is greater, the force to be combined will be smaller, and the cloth will be tensed with a little force and the shrinkage will be smaller. However, in the correction device, it is impossible to correct stitch data properly for every single stitch in consideration of various conditions like the angle between stitches and the tendency for shrinkage which differs according to types of the cloth.

SUMMARY OF THE INVENTION

The invention was made in consideration of the above circumstances, and it is therefore an object of the invention to provide a stitch data compensation device wherein stitch data representing a movement amount of a cloth to be sewn in the X- and Y-directions can be corrected according to an angle between two consecutive stitches to eliminate sewing shrinkage from the cloth to be sewn, thus assuring fine stitches will be sewn on the cloth without any effect from sewing shrinkage.

To accomplish the above object, the invention provides a stitch data compensation device for correcting stitch data representing X- and Y-direction movement amounts of a work cloth relative to a needle of a sewing machine, characterized in that the X- and Y-direction movement amounts for stitch data numbered n (n=natural number) can be corrected respectively according to an angle between a stitch formed based on stitch data numbered n and a consecutive stitch formed based on stitch data numbered n+1.

If the stitch data is used after compensation is made, it will become possible to cope with the shrinkage of the work cloth due to a thread tension during sewing, and to prevent uneven finished patterns, such as a gap in a satin pattern, a jagged fill pattern, and running stitches, to be made on the return when the sewing direction is reversed, deviating from the ones already made on the go.

In one preferred form of the invention, the smaller the angle between a stitch formed based on stitch data numbered n and a stitch formed based on stitch data numbered n+1 is, the greater the X- and Y-direction movement amounts for stitch data numbered n can be corrected respectively.

For example, when a satin or fill pattern is formed, it will become thicker than the actual pattern, however, an uneven finished pattern can be prevented. When running stitching is used, it slightly deforms at the comers, but the stitches, which are to be made on the return when the sewing direction is reversed, overlap just on the ones already made on the go, resulting in obtaining a beautiful sewing finish.

In another preferred form of the invention, the X- and Y-direction movement amounts for stitch data numbered n are corrected considering parameters inherent in the work cloth. This means stitch data can be properly corrected according to the different types of work cloth.

In another preferred form of the invention, the parameters inherent in the work cloth are related to the tendency of the work cloth to shrink. Thus, stitch data can be corrected properly according to the tendency of the work cloth to shrink.

In another preferred form of the invention, parameter setting means is also provided. Therefore, parameters inherent in the work cloth can be set freely.

In a further preferred form of the invention, the compensation amount in the X-direction Hx and that in the Y-direction Hy for stitch data numbered n are calculated using the following formulas respectively:

$$Hx=(Px/4)\times\{Xn/(Xn^2+Yn^2)^{1/2}-Xn+1/(Xn+1^2+Yn+1^2)^{1/2}\}$$

$$Hy=(Py/4)\times\{Yn/(Xn^2+Yn^2)^{1/2}-Yn+1/(Xn+1^2+Yn+1^2)^{1/2}\}$$

where Px and Py represent parameters regarding the tendency to sewing shrinkage of the work cloth in the X- and Y-directions respectively, Xn and Yn are movement amounts in X- and Y-directions for stitch data numbered n respectively, and Xn+1 and Yn+1 are movement amounts in X- and Y-directions for stitch data numbered n+1 respectively.

From the above formulas, compensation for stitch data numbered n can be calculated properly according to the angle between two stitches and the tendency to sewing shrinkage of the work cloth.

In another preferred form of the invention, the X-direction movement amount Xn and the Y-direction movement amount Yn for stitch data numbered n are calculated using the following formulas respectively:

$$Xn \leftarrow Xn + Hx - Hxr$$

$$Yn \leftarrow Yn + Hy - Hyr$$

where Hxr and Hyr represent the previous compensation amounts in the X- and Y-directions respectively.

The X- and Y-direction movement amounts for stitch data numbered n can be surely calculated from the above formulas.

In a further preferred form of the invention, the invention comprises means for obtaining the X- and Y-direction movement amounts for stitch data numbered n (n=natural number), means for obtaining the X- and Y-direction movement amounts for stitch data numbered n+1, calculating means for calculating a compensation for sewing shrinkage based on the X- and Y-direction movement amounts for stitch data numbered n and n+1, and correcting means for correcting the X- and Y-direction movement amounts for stitch data numbered n based on the compensation for sewing shrinkage.

Therefore, the X- and Y-direction movement amount for stitch data numbered n and then n+1 are obtained, the compensation for sewing shrinkage is calculated based on the obtained X- and Y-direction movement amounts, and then the X- and Y-direction movement amounts for stitch data numbered n are corrected based on the obtained compensation for sewing shrinkage. For this reason, the X- and Y-direction movement amounts can be calculated so as to match for each stitch.

In another preferred form of the invention, means for obtaining sewing shrinkage parameters relating to the tendency toward sewing shrinkage of the work cloth is further included. The calculating means calculates the compensation for sewing shrinkage based on the sewing shrinkage parameters and the X- and Y-direction movement amounts for stitch data numbered n and n+1.

Therefore, the sewing shrinkage parameters relating to the tendency toward sewing shrinkage of the work cloth are obtained, and the compensation for sewing shrinkage is calculated based on the sewing shrinkage parameters and the X- and Y-direction movement amounts for stitch data numbered n and n+1. For this reason, more suitable compensation can be calculated so as to cope with the tendency toward sewing shrinkage inherent in the work cloth.

In a further preferred form of the invention, there is provided a computer-readable storage medium that stores a program for correcting stitch data representing the X- and Y-direction movement amounts of a work cloth relative to a needle. The program comprises a routine to obtain the X- and Y-direction movement amounts for stitch data numbered n (n=natural number); a routine to obtain the X- and Y-direction movement amounts for stitch data numbered n+1; a routine to calculate compensation for sewing shrinkage based on the X- and Y-direction movement amounts for stitch data numbered n and n+1; and a routine to correct the X- and Y-direction movement amounts for stitch data numbered n based on the compensation for sewing shrinkage.

Therefore, it is possible to calculate the X- and Y-direction movement amounts so as to match for each stitch by reading the program, that is stored in the computer-readable storage medium, such as a floppy disk and a CD-ROM, into a computer and executing it on the computer.

BRIEF DESCRIPTION OF THE DRAWINGS

The invention will be described in greater detail with reference to preferred embodiments thereof and the accompanying drawings wherein;

FIG. 2(*b*) is a schematic diagram of pattern to be made with a running stitching;

FIG. 2(*c*) is a schematic diagram of pattern to be made with the fill stitching;

DETAILED DESCRIPTION OF PREFERRED EMBODIMENTS

Figure 5:
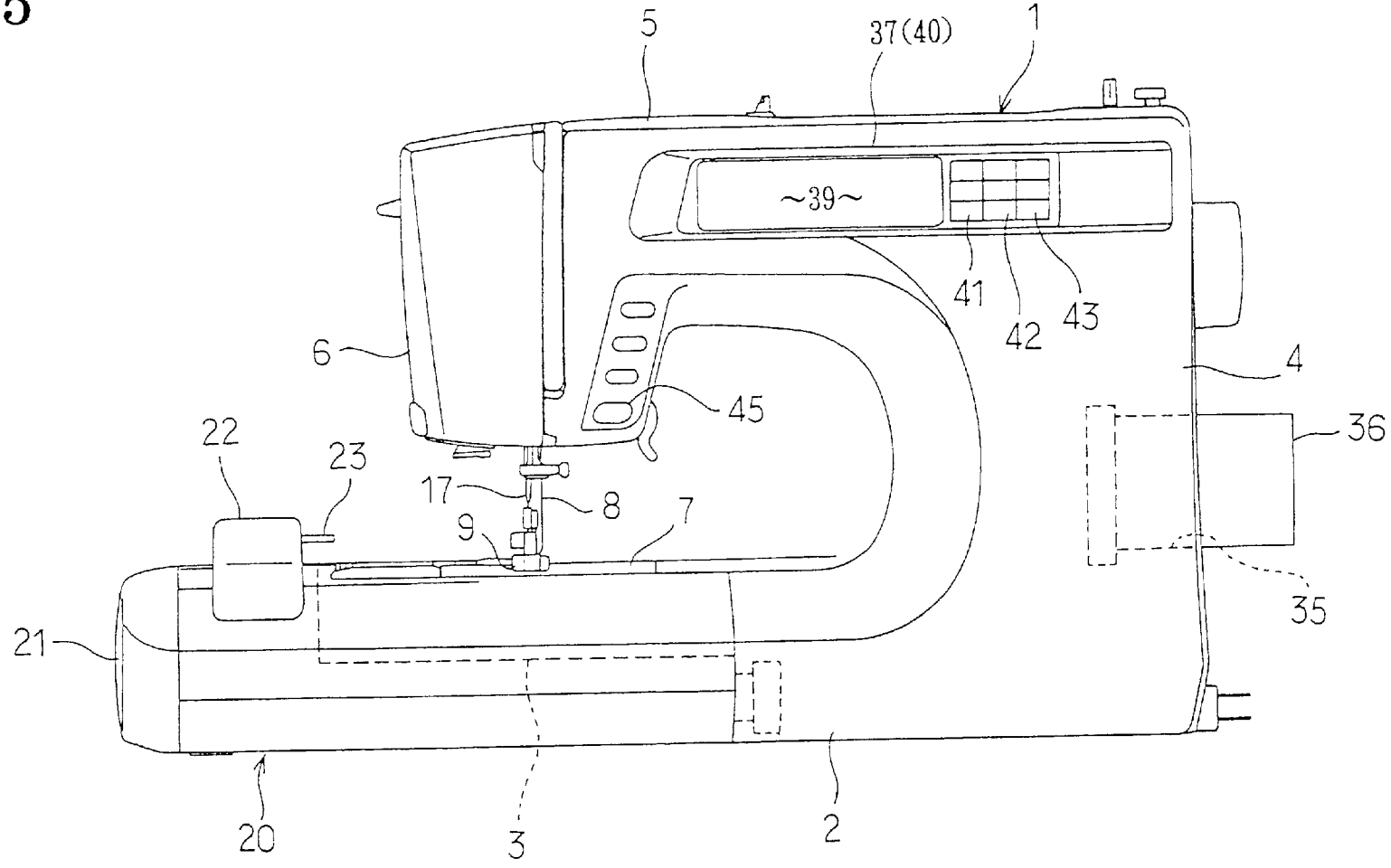
FIG. 5 shows the appearance of the sewing machine.

One preferred embodiment of the invention will be described in detail with reference to the accompanying drawings. The embodiment refers to the invention which is applied to a home-use sewing machine with an embroidery function. A machine frame 1, as shown in FIG. 5, has a bed 2, a free arm 3 extended to the left therefrom, a leg portion 4 extended upward from the bed 2, an arm portion 5 extended to the left from the upper end of the leg portion 4, and a head portion 6 extended downward from the left of the arm portion 5. The free arm 3 is attached to the needle plate 7.

A presser bar 8 is attached to the head portion 6 in the machine frame 1 so that it can move up and down. The bottom of the presser bar 8 is connected to a presser foot 9 that is detachably fixed. The presser bar 8 is forced downward by a spring (not shown), and the presser foot 9 is pressed against the top of the needle plate 7.

Figure 4:
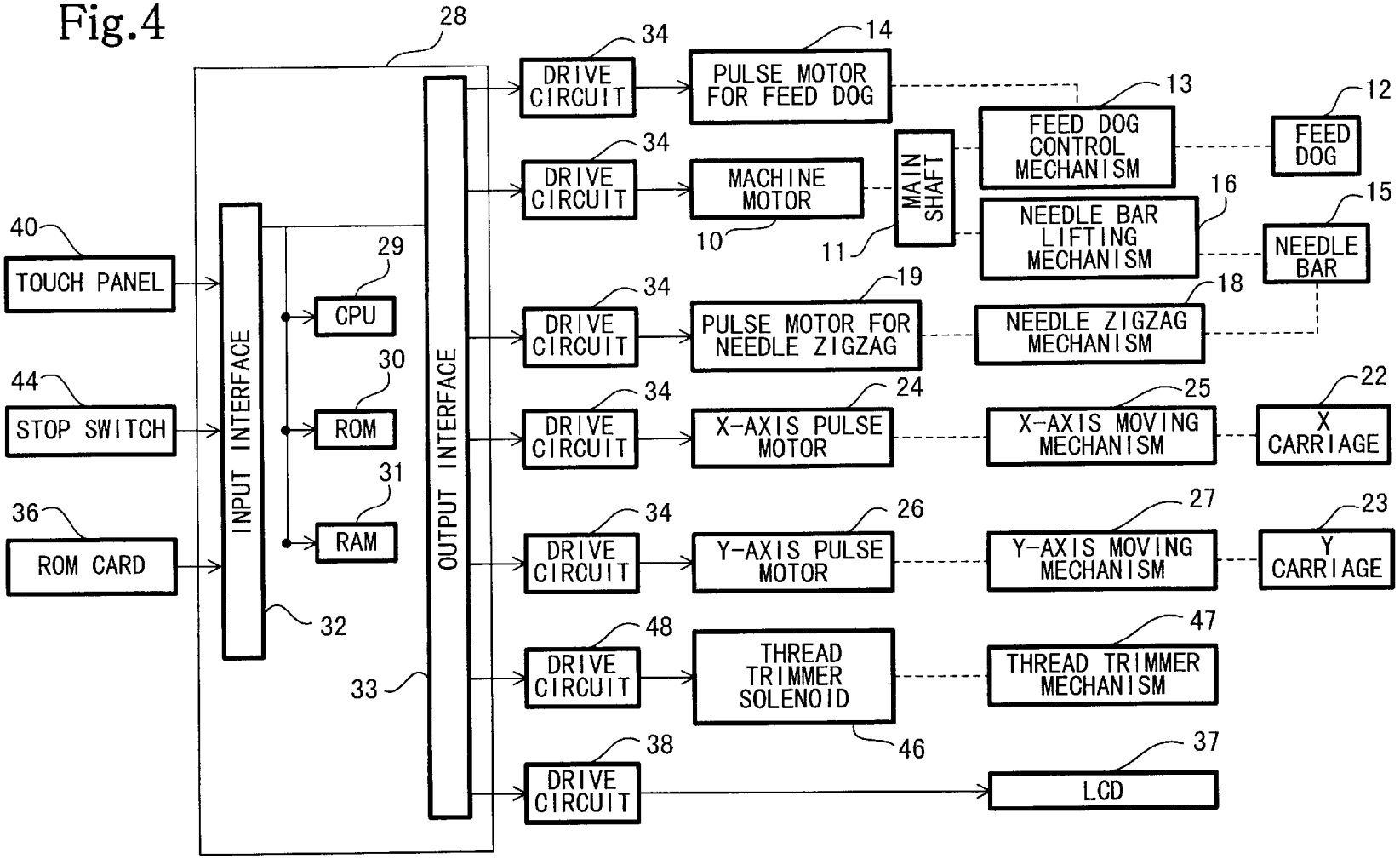
FIG. 4 is a block diagram of the entire structure.

A machine motor 10, as shown in FIG. 4, is installed in the machine frame I and a main shaft 11 is mechanically linked to a rotating shaft of the machine motor 10. A feed dog 12, in FIG. 4, is installed in the free arm 3 in the machine frame 1, and is mechanically linked to the main shaft 11 via a feed dog control mechanism 13. The feed dog control mechanism 13 converts the turning force of the main shaft 11 into reciprocating motion back and forth or right and left for transmission to the feed dog 12. When the main shaft 11 rotates, the feed dog 12 moves back and forth or right and left.

The feed dog control mechanism 13 is driven by a feed dog pulse motor 14. According to the rotational amount of the pulse motor 14, the forward feeding mode and backward feeding mode are switched. When the feed dog control mechanism 13 is switched to the forward mode, the feed dog 12 rises during the forward feeding and lowers during the backward feeding, a work cloth (not shown) which is on the top of the needle plate 7 and held by the presser foot 9 is fed forward. When the feed dog control mechanism 13 is switched to the backward mode, the feed dog 12 lowers during the forward feeding and rises during the backward feeding, and the work cloth on the needle plate 7 pressed by the presser foot 9 is fed backward.

A needle bar 15, in FIG. 4, is installed to the head portion 6 in the machine frame 1 and mechanically linked to the main shaft 11 via a needle bar lifting mechanism 16. The needle bar lifting mechanism 16 converts the turning force of the main shaft 11 into reciprocating motion back and forth, which is transmitted to the needle bar 15. When the main shaft 11 rotates, the needle bar 15 moves up and down along with the feed dog 12. A needle 17 is attached to the lower end of the needle bar 15 so that it can be detachably fixed thereto. While the main shaft 11 rotates, the feed dog 12 feeds the work cloth forward or backward, the needle 17 moves up and down so that it penetrates into the work cloth, and stitches are formed on the work cloth.

A needle zigzag mechanism 18 is mechanically linked to the needle bar 15, as shown in FIG. 4. The needle zigzag mechanism 18 is driven by a needle zigzag pulse motor 19. The right and left movement of the needle bar 15 is adjusted according to the rotational amount of the pulse motor 19, and zigzag stitches are formed on the work cloth. The feed dog control mechanism 13 has a function that changes the stroke of the back and forth movement of the feed dog 12 according to the rotational amount of the pulse motor 14 to vary stitch lengths.

An embroidery device 20, that is detachably installed to the free arm 3 of the machine frame 1, is shown in FIG. 5. The embroidery device 20 will now be explained. A detachable embroidery mechanism 21 is attached to the free arm 3. An X-carriage 22 is attached to the embroidery mechanism 21 so that it can be moved right and left (in the X-direction). A Y-carriage 23 is attached to the X-carriage 22 so that it can be moved back and forth (in the Y-direction). The Y-carriage 23 also has an embroidery frame (not shown) which is detachable and holds a work cloth.

The embroidery mechanism 21 has a built-in X-axis pulse motor 24 (referring to FIG. 4). A turning shaft of the X-axis pulse motor 24 is mechanically linked to the X-carriage 22 via an X-direction moving mechanism 25 (referring to FIG. 4). When the X-axis pulse motor 24 runs, the X-carriage 22, the Y-carriage 23, and the embroidery frame move jointly in the X-direction.

The embroidery mechanism 21 also has a built-in Y-axis pulse motor 26 (referring to FIG. 4). A turning shaft of the Y-axis pulse motor 26 is mechanically linked to the Y-carriage 23 via a Y-direction moving mechanism 27 (referring to FIG. 4). When the Y-axis pulse motor 26 runs, the Y-carriage 23 and the embroidery frame move jointly in the Y-direction.

As shown in FIG. 4, a control device 28 mainly consisting of a microcomputer is installed in the machine frame 1. The control device 28 has CPU 29, ROM 30, RAM 31, input interface 32, and output interface 33. The machine motor 10, the feed dog pulse motor 14, the zigzag pulse motor 19, the X-axis pulse motor 24, and the Y-axis pulse motor 26 are electronically connected to the output interface 33 of the control device 28 via a drive circuit 34. The control device 28 is equivalent to the stitch data compensation device.

A card slot 35 is provided in the leg portion 4 of the machine frame 1, as shown in FIG. 5. When a ROM card 36 is inserted into the card slot 35, the ROM card 36 is electronically connected to the input interface 32 of the control device 28, as shown in FIG. 4. The ROM card 36 is used to store a plurality of pattern data that draw outline shapes for embroidery patterns.

A liquid crystal display (LCD) 37, which is an elongated rectangle and includes a display area 39 (as shown in FIG. 5) is embedded in the arm 5 of the machine frame 1. The LCD 37 is, as shown in FIG. 4, electronically connected to the output interface 33 of the control device 28 via a drive circuit 38.

A transparent touch panel 40 is attached on the LCD 37, and, as shown in FIG. 4, electronically connected to the input interface 32 of the control device 28. An embroidery key 41, a start key 42, and a compensation key 43 are printed on the touch panel 40. The control device 28 detects the operations of keys 41 to 43 based on the output signal issued from the touch panel 40.

When the control device 28 detects the operation of the embroidery key 41, the display area 39 on the LCD 37 indicates a plurality of embroidery patterns. With this circumstance, detecting that an embroidery pattern has been touched according to the output signal issued from the touch panel 40, the control device 28 reads a pattern data corresponding to the embroidery pattern, that has been touched, from the ROM card 36, processes the pattern data based on the control program of the ROM 30, and sets the large amount of stitch data. Each stitch data indicates an operation for one stitch, mainly comprising a control code, such as a thread trimming code, feed code, stitch code, and backtacking code; the X-direction movement amount of the work cloth relative to the needle 17; and the Y-direction movement amount of the work cloth relative to the needle 17.

When the control device 28 detects the operation of the start key 42, the display area 39 on the LCD 37 indicates a plurality of sewing patterns. With this circumstance, detecting that a sewing pattern has been touched according to the output signal issued from the touch panel 40, the control device 28 sets the large amount of stitch data corresponding to the sewing pattern that has been touched. Each stitch data mainly consists of the control code, the X- and Y-direction movement amounts of the work cloth, with the same as stitch data for embroidery. Stitch data during embroidering and sewing are equivalent to movement data.

An operation stop switch 44 is connected to the input interface 32 of the control device 28 as shown in FIG. 4. When the control device 28 detects that a stop key 45 has been pressed from the output signal of the operation stop switch 44, sewing or embroidering will start or stop. The operation stop key 45 is, as shown in FIG. 5, installed on the head portion 6 in the machine frame 1.

When the control device 28 detects the operation of the compensation key 43, the display area 39 on the LCD 37 indicates a mode where a parameter should be set. The mode shows parameter input keys for both X- and Y-directions (not shown). The control device 28 detects operations of X- and Y parameter input keys based on output signals issued from the touch panel 40, sets Px, a parameter value in the X-direction, and Py, a parameter value in the Y-direction, and then displays them on the display area 39. Px and Py are set to numbers including 0.

Figure 3:
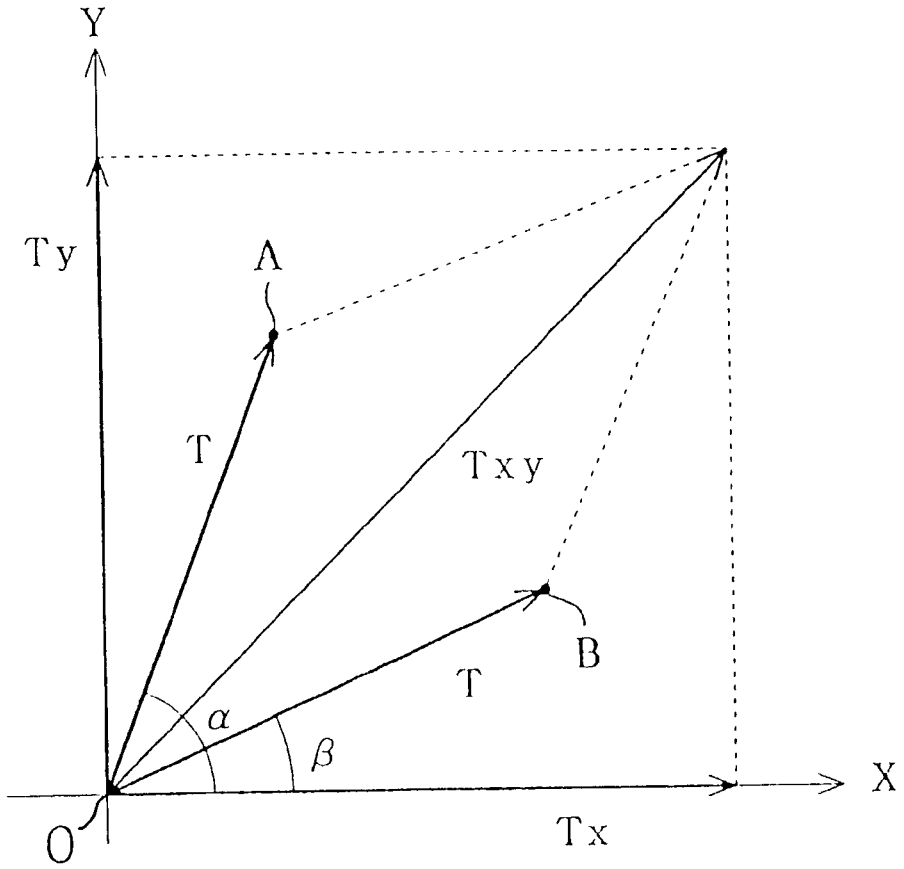
FIG. 3 is a diagram that indicates the principle of formulas related to the sewing shrinkage.

In the ROM 30 of the control device 28, formulas related to the compensation for the sewing shrinkage of the work cloth are stored. The formulas related to the compensation for the sewing shrinkage of the work cloth will now be explained referring to FIG. 3. Assume that from center of origin α a force T is applied in the direction that is formed by the X-axis and angle a and in the direction that is formed by the X-axis and angle β. In this case, force Txy that is applied in the direction formed by X-axis and an angle $\{(\alpha+\beta)/2\}°$, force Tx that is applied in the X-direction, and force Ty that is applied in the Y-direction are found from the following formulas (1) to (3).

$$Txy=2\times T\times\cos\{(\alpha-\beta)/2\} \quad (1)$$

$$Tx=Txy\times\cos\{(\alpha+\beta)/2\}=2\times T\times\cos\{(\alpha-\beta)/2\}\times\cos\{(\alpha+\beta)/2\} \quad (2)$$

$$Ty=Txy\times\sin\{(\alpha+\beta)/2\}=2\times T\times\cos\{(\alpha-\beta)/2\}\times\sin\{(\alpha+\beta)/2\} \quad (3)$$

Force T is equivalent to the thread tension when the work cloth is moved in the X- or Y-direction to penetrate the needle 17 in points A through O to B. Also, the shrinkage of the work cloth is in proportion to the thread tension. Therefore, formulas (2) and (3) that express the thread tension can be used as the ones to indicate the degree of the shrinkage of the work cloth during sewing. On the other hand, the actual shrinkage of the work cloth is affected by the tendency toward the sewing shrinkage which differs according to the type of work cloth. Suppose that the coefficient for the tendency toward sewing shrinkage of the work cloth in the X-direction is Kx (the shrinkage of a work cloth when a force of 2×T is applied in the X-direction), and the one in the Y-direction is Ky (the shrinkage of a work cloth when a force of 2×T is applied in the Y-direction). The shrinkage amount in the X-direction Hx' and that in the Y-direction Hy' can be expressed by the following formulas (4) and (5):

$$Hx'=Kx\times\cos\{(\alpha-\beta)/2\}\times\cos\{(\alpha+\beta)/2\}=Kx\times\{(\cos\alpha+\cos\beta)/2\} \quad (4)$$

$$Hy'=Ky\times\cos\{(\alpha-\beta)/2\}\times\sin\{(\alpha+\beta)/2\}=Ky\times\{(\sin\alpha+\sin\beta)/2\} \quad (5)$$

Supposing Px=2×Kx, Py=2×Ky, compensation amount in the X-direction Hx and that in the Y-direction Hy can be expressed by the following formulas (6) and (7):

$$Hx=(Px/4)\times(-\cos\alpha-\cos\beta) \quad (6)$$

$$Hy=(Py/4)\times(-\sin\alpha-\sin\beta) \quad (7)$$

Assuming that the current X-direction movement amount is Xn, the current Y-direction movement amount is Yn, the next X-direction movement amount is Xn+1, and the next Y-direction movement amount is Yn+1, the following formulas (8) to (11) are valid.

$$-\cos\alpha=Xn/(Xn^2+Yn^2)^{1/2} \quad (8)$$

$$-\cos\beta=-Xn+1/(Xn+1^2+Yn+1^2)^{1/2} \quad (9)$$

$$-\sin\alpha=Yn/(Xn^2+Yn^2)^{1/2} \quad (10)$$

$$-\sin\beta=-Yn+1/(Xn+1^2+Yn+1^2)^{1/2} \quad (11)$$

The following formulas (12) and (13) can be found by rearranging formulas (6) and (7) based on the formulas (8) to (11):

$$Hx=(Px/4)\times\{Xn/(Xn^2+Yn^2)^{1/2}-Xn+1/(Xn+1^2+Yn+1^2)^{1/2}\} \quad (12)$$

$$Hy=(Py/4)\times\{Yn/(Xn^2+Yn^2)^{1/2}-Yn+1/(Xn+1^2+Yn+1^2)^{1/2}\} \quad (13)$$

Figure 1:
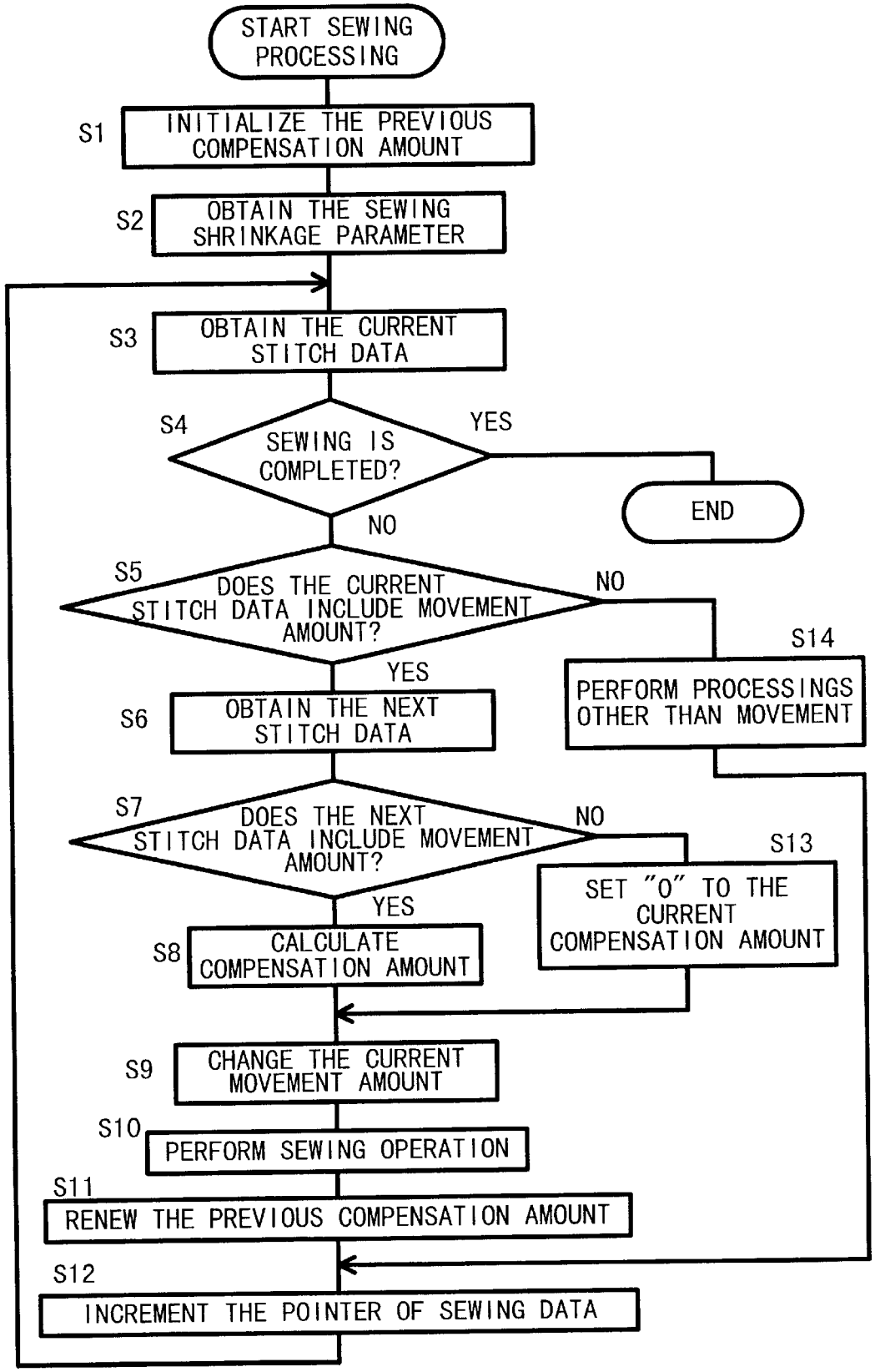
FIG. 1 is a flowchart that indicates the processes of the control device according to one embodiment of the invention.

Formulas (12) and (13) are stored in the ROM 30 of the control device 28. The control device 28 processes stitch data during sewing or embroidering based on the formulas (12) and (13), and performs sewing operations while correcting the X- and Y-direction movement amounts in response to the sewing shrinkage of the work cloth. FIG. 1 is a flowchart showing control programs to perform sewing operations that are stored in the ROM 30 of the control device 28. The control programs will now be explained referring to FIG. 1.

When the control device 28 detects the operation of the operation stop key 45, the operation goes to step S1. At step S1, it initializes the previous compensation amount in the X-direction Hxr and that in the Y-direction Hyr (reset to "0"), and then goes to step S2. At step S2, it reads sewing shrinkage parameters Px and Py, and then goes to step S3.

When the control device 28 goes to step S3, it reads the current stitch data, and then goes to step S4 to make a judgment on whether sewing is completed. The judgment on whether sewing is completed is made according to an end command of stitch data or when the operation stop key 45 is pressed again. If something showing that sewing is to be continued is found at step S4, it goes to step S5.

Figure 2A:
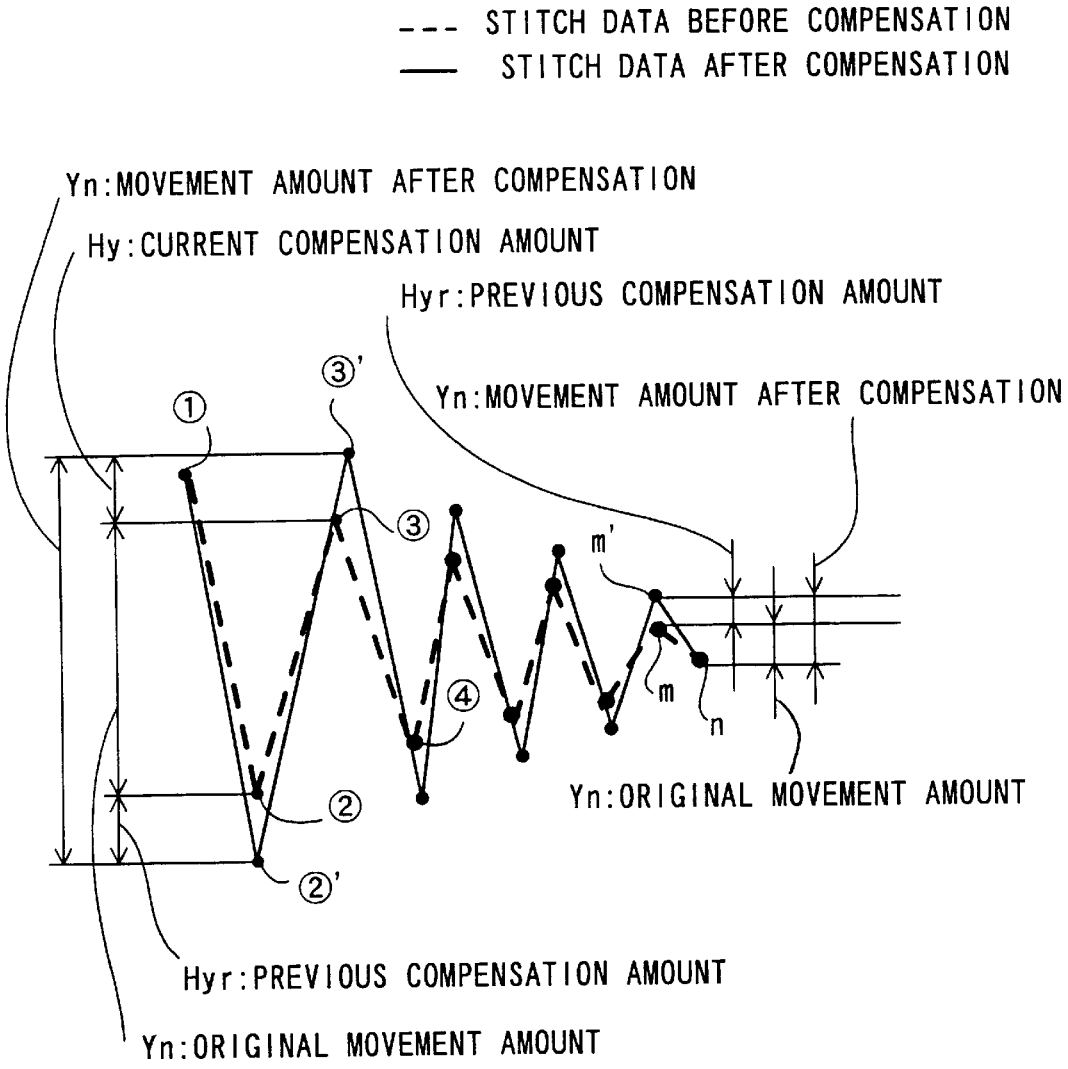
FIG. 2(*a*) is a schematic diagram of pattern to be made with satin stitching.
Figure 2B:
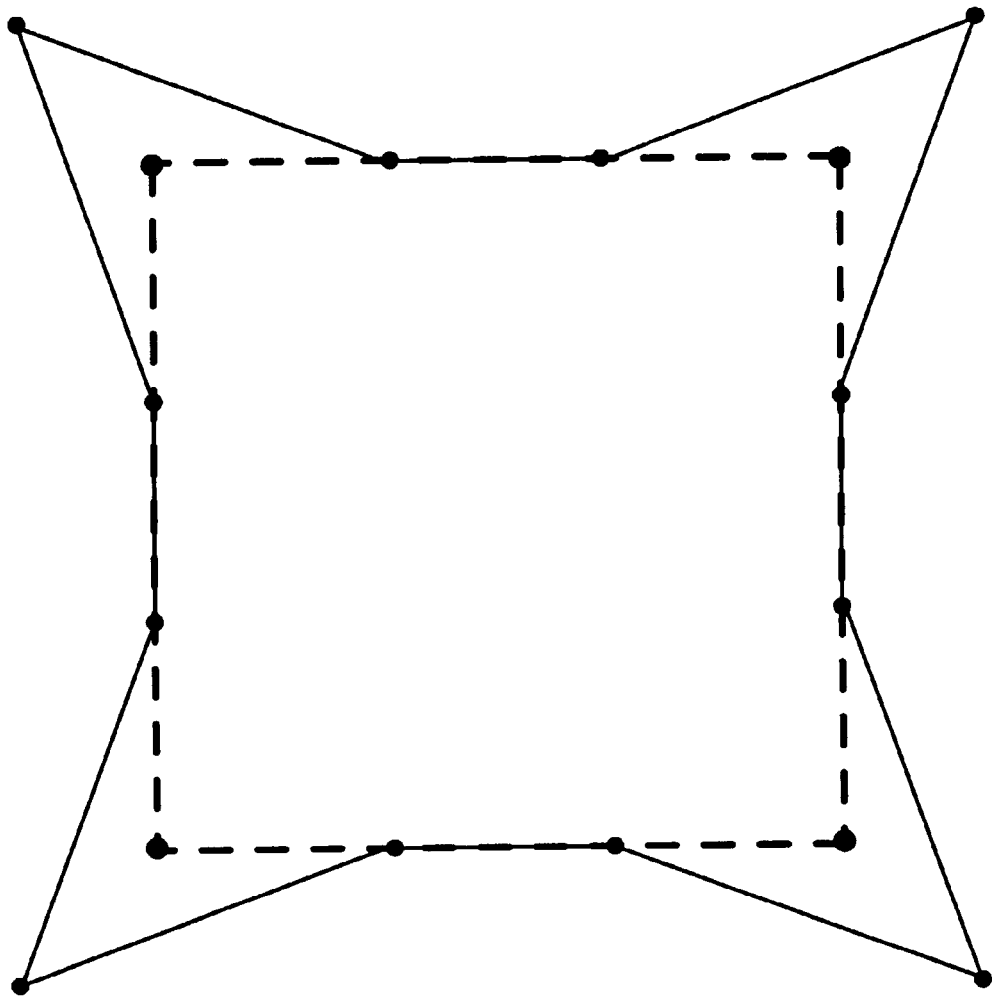
Figure 2C:
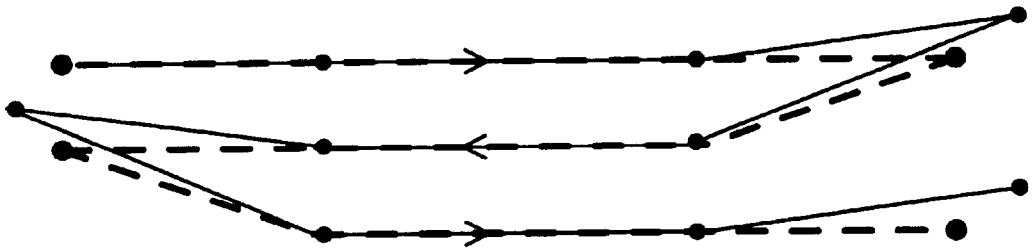

When the control device 28 goes to step S5, it judges whether a control code which indicates the movement of the work cloth (e.g., feed, stitch) is added to the stitch data read at step S3. In FIG. 2(*a*), a dashed line shows stitch data to form satin pattern and a solid line shows stitch data after the compensation for sewing shrinkage is made.

For example, when the current stitch data is to drop the needle 17 from point 1 to point 2 in FIG. 2(*a*), it includes a control code which indicates the work cloth is moved. (The X-direction movement amount Xn and Y-direction movement amount Yn are set to positive values.) Therefore, the control device 28 shifts from step S5 to step S6 in FIG. 1 to read the next stitch data, and goes to step S7 to judge whether the next stitch data includes a control code which indicates the work cloth is moved.

The next stitch data is to drop the needle from point 2 to point 3 in FIG. 2(*a*), and it includes a control code which indicates the work cloth is moved. (The X-direction movement amount Xn is set to a positive value and Y-direction movement amount Yn is set to a negative value.) Therefore, the control device 28 judges "YES" at step S7, and goes to step S8 to calculate compensation amount in the X-direction Hx and compensation amount in the Y-direction Hy by substituting Xn and Yn for the current stitch data and Xn+1 and Yn+1 for the next stitch data into the above formulas (12) and (13).

When the control device 28 calculates the compensation amount in the X-direction Hx and compensation amount in the Y-direction Hy, it goes to step S9 in FIG. 1 to correct the values for Xn and Yn by calculating the following formulas (14) and (15), and then goes to step S10.

$$Xn\leftarrow Xn(\text{movement amount of stitch data})+Hx(\text{the current compensation amount})-Hxr(\text{the previous compensation amount}) \quad (14)$$

$$Yn\leftarrow Yn(\text{movement amount of stitch data})+Hy(\text{the current compensation amount})-Hyr(\text{the previous compensation amount}) \quad (15)$$

When the control device 28 goes to step S10, it controls prescribed actuators according to X-direction movement amount Xn and Y-direction movement amount Yn to perform sewing operation. It goes to step S11 to replace Hxr and Hyr of the previous compensation amounts with Hx and Hy of the current compensation amount using the following formulas (16) and (17). Then it goes to step S12 to advance the pointer of the sewing data and returns to step S3.

$$Hxr\leftarrow Hx \quad (16)$$

$$Hyr\leftarrow Hy \quad (17)$$

When the control device 28 returns to step S3, it reads the current stitch data and shifts from step S4 to step S5. The stitch data is to drop the needle from point 2 to point 3 in FIG. 2(*a*), and includes a control code which indicates the work cloth is moved. Therefore, it shifts from step S5 to step S6 to read the next stitch data, and goes to step S7.

The next stitch data is to drop the needle from point 3 to point 4 in FIG. 2(*a*), and includes a control code which indicates the work cloth is moved. Therefore, the control device 28 judges "YES" at step S7, and goes to step S8 to calculate compensation amount in the X-direction Hx and compensation amount in the Y-direction Hy based on the above formulas (12) and (13). Then, it goes to step S9 in FIG. 1 to correct the values for Xn and Yn by calculating the above formulas (14) and (15), and then goes to step S10.

Points 2' and 3' in FIG. 2(*a*) are the places the needle penetrates after compensation. Here, the stitch data that the needle moves from point 2 to point 3 is called the current stitch data, and that the needle moves from point 3 to point 4 is called the next stitch data.

When the control device 28 goes to step S10 in FIG. 1, it controls prescribed actuators according to the current movement amounts Xn and Yn and performs sewing operation. Then, it moves to step S11 to replace the previous compensation amounts Hxr and Hyr with the current compensation amounts Hx and Hy. After that, it shifts to step S12 to advance the pointer of the sewing data, and returns to step S3.

When the control device 28 returns to step S3, it repeats steps S3 through S12. After that, it reads the stitch data in which the needle is dropped from point m to point n in FIG. 2(*a*) at step S3, moves from step S5 to step S6 to read the next stitch data, and goes to step S7. If the next stitch data is to perform thread trimming at point n in FIG. 2(*a*), for example, it does not include a control code which indicates the work cloth is moved. Therefore, it judges "NO" at step S7, goes to step S13 to set each of the current compensation amounts Hx and Hy to 0, and shifts to step S9.

When the control device 28 moves to step S9, it corrects the current movement amounts Xn and Yn based on the formulas (14) and (15), and goes to step S110. Point m' in FIG. 2(*a*) indicates the place where the needle penetrates after the previous compensation is made. If the previous needle penetration point is corrected from point m to point m', as is obvious in FIG. 2(*a*), the previous compensation amounts are added to the current ones even if they are 0, and the current data movement amounts are renewed.

When the control device 28 goes to step S10 in FIG. 1, it performs sewing operation according to the current X-direction movement amount Xn and Y-direction movement amount Yn, and goes to step S11 to replace previous compensation amount in the X-direction Hxr and previous compensation amount in the Y-direction Hyr with the current compensation amounts Hx and Hy. Then it shifts to step S12 to advance the pointer of the sewing data, and returns to step S3.

When the control device 28 returns to step S3, it reads the current stitch data and moves from step S4 to S5. The stitch data is used to perform thread trimming and does not include a control code which indicates the work cloth is moved. Therefore, it moves from step S5 to S14, performs thread trimming therein, and goes to step S12. Here, it advances the pointer of the sewing data and returns to step S3.

In the free arm 3 in the machine frame 1, a thread trimmer mechanism 47 (refer to FIG. 4), which is driven by a thread trimming solenoid 46 (refer to FIG. 4), is provided. Upon thread trimming, the control device 28 excites the thread trimming solenoid 46 through a drive circuit 48 (refer to FIG. 4) and activates the thread trimmer mechanism 47 to cut upper and lower threads under the needle plate 7.

When the control device 28 returns to step S3 in FIG. 1, it shifts from step S3 to S4 and reads the current stitch data. For example, if the current stitch data is used to command the sewing finish, the control device 28 judges "YES" at step 4 and completes the sewing operation.

According to the above embodiment, the X-direction movement amount Xn and Y-direction movement amount Yn for stitch data numbered n (=natural number) are corrected depending on an angle formed between a stitch that is formed based on stitch data numbered n, and a stitch that is formed based on stitch data numbered n+1. Therefore the compensation can cope with the shrinkage due to a tension of thread sewn into the work cloth, resulting in the prevention of an uneven finished pattern, such as a gap in a satin pattern, a jagged fill pattern, or stitches to be made on the return when the sewing direction is reversed deviating from the ones already made on the go when running stitching is selected.

Also, X-direction movement amount Xn and Y-direction movement amount Yn are greatly corrected to cope with a smaller angle that is formed between the two stitches. Therefore when a satin or fill pattern is formed, as shown in the solid lines in FIGS. 2(*a*) and (*c*), it becomes thicker than the actual pattern, however, an uneven, or distorted, finished pattern is prevented. When a rectangle pattern is made with running stitching, as shown in FIG. 2(*b*), its corners become slightly deformed, however, the stitches, which are to be made when the sewing direction is reversed, overlap just on the ones already made, resulting in obtaining an overall beautiful finish.

X-direction movement amount Xn and Y-direction movement amount Yn are also corrected in consideration of an angle determined by the two stitches with the X-direction parameter Px and the Y-direction parameter Py. On this account, for example, an operator can do trial sewing with the values for Hx and Hy set to 0 to check the actual sewing results, and then input the values for Px and Py. Therefore, an uneven finished pattern can be prevented without any attention to consider the shrinkage allowance that differs according to the type of work cloth being sewn.

In the above embodiment, the ROM card 36 is connected to the control device 28, however, the invention is not limited to this. An image scanner may be connected instead. In this case, for example, the image scanner scans a pattern, and passes image data of the pattern to the control device 28. The control device 28 sets stitch data based on the image data.

Also, in the above embodiment, the invention may correct X-direction movement amount Xn and Y-direction movement amount Yn according to an angle, formed between the two stitches, and detect that the feeding direction of the work cloth is reversed in the X- or Y-direction based on the stitch data. When the feeding direction of the work cloth is reversed, a predetermined value can be added to Xn and Yn to cover the insufficient mechanical movement which may occur due to the backlash of the X-direction moving mechanism 25 and the Y-direction moving mechanism 27.

Moreover, in the above embodiment, the X-direction parameter Px and Y-direction parameter Py are set to any numbers including 0 by using parameter input keys, but the invention is not limited to this case only. For example, the upper limit may be placed on parameters for Px and Py.

In the above embodiment, the compensation key 43 is positioned on the touch panel 40, but the invention is not limited to this case only. The compensation key 43 may be placed next the operation stop key 45.

In the above embodiment, the invention is applied to a sewing machine in which a work cloth can be moved in the X- and Y-directions according to stitch data, but is not limited to this case only. It may otherwise be applied to a sewing machine in which the needle 17 can be moved in the X- and Y-directions according to stitch data.

Moreover, in the above embodiment, the invention is applied to a home-use sewing machine with embroidery function, but is not limited to this case only. For example, the invention may be applied to an external data creation device that enables the creation of stitch data based on pattern data read from a ROM card or image data read from an image scanner and to send the image data to the control device 28; an industrial sewing machine exclusive for satin and fill stitching; or a stitch data compensation device for exclusive use that corrects the stitch data given from external media and sends the corrected data to other devices such as a sewing machine.

The operation procedure shown in the flowchart of FIG. 1, and a computer program describing formulas (12) and (13) may be stored in a computer readable recording medium such as a floppy disk and a CD-ROM, so as to perform stitch data compensation on a computer by reading the program from the computer readable storage medium into the computer for execution.

What is claimed is:

1. A stitch data compensation device for correcting stitch data representing X- and Y- direction movement amounts of a work cloth relative to a needle of a sewing machine, comprising:

means for obtaining X- and Y- direction movement amounts for stitch data numbered n (n=natural number) respectively;

means for obtaining X- and Y- direction movement amounts for stitch data numbered n+1 respectively; and means for correcting the X- and Y- direction movement amounts for the stitch data numbered n respectively according to an angle between a stitch formed based on the stitch data numbered n and a consecutive stitch formed based on the stitch data numbered n+1.

2. The stitch data compensation device according to claim 1, wherein the smaller the angle between a stitch formed based on the stitch data numbered n and a stitch formed based on the stitch data numbered n+1 is, the greater the X- and Y-direction movement amounts for the stitch data numbered n can be corrected respectively.

3. The stitch data compensation device according to claim 1, wherein the X- and Y-direction movement amounts for the stitch data numbered n can be corrected considering parameters inherent in the work cloth.

4. The stitch data compensation device according to claim 3, wherein the parameters inherent in the work cloth are related to the tendency toward sewing shrinkage of the work cloth.

5. The stitch data compensation device according to claim 3, further comprising parameter setting means for setting predetermined parameters.

6. The stitch data compensation device according to claim 3, wherein compensation amount in the X-direction Hx and that in the Y-direction Hy for the stitch data numbered n are calculated using the following formulas respectively:

$$Hx=(Px/4)\times\{Xn/(Xn^2+Yn^2)^{1/2}-Xn+1/(Xn+1^2+Yn+1^2)^{1/2}\}$$

$$Hy=(Py/4)\times\{Yn/(Xn^2+Yn^2)^{1/2}-Yn+1/(Xn+1^2+Yn+1^2)^{1/2}\}$$

where Px and Py represent parameters regarding the tendency toward sewing shrinkage of the work cloth in the X- and Y-directions respectively, Xn and Yn represent movement amounts in X- and Y-directions for stitch data numbered n respectively, and Xn+1 and Yn+1 represent movement amounts in X- and Y-directions for stitch data numbered n+1 respectively.

7. The stitch data compensation device according to claim 6, wherein an X-direction movement amount Xn and a Y-direction movement amount Yn for stitch data numbered n are calculated using the following formulas respectively:

$$Xn\leftarrow Xn+Hx-Hxr$$

$$Yn\leftarrow Yn+Hy-Hyr$$

where Hxr and Hyr represent the previous compensation amounts in the X- and Y-directions respectively.

8. A stitch data compensation device for correcting stitch data representing X- and Y-direction movement amounts of a work cloth relative to a needle of a sewing machine, comprising:

means for obtaining the X- and Y-direction movement amounts for stitch data numbered n (n=natural number) respectively;

means for obtaining the X- and Y-direction movement amounts for stitch data numbered n+1 respectively;

calculating means for calculating a compensation for sewing shrinkage based on the X- and Y-direction movement amounts for stitch data numbered both n and n+1; and correcting means for correcting the X- and Y-direction movement amounts for stitch data numbered n based on the compensation for sewing shrinkage.

9. The stitch data compensation device according to claim 8, further comprising means for obtaining sewing shrinkage parameters regarding a tendency toward sewing shrinkage of the work cloth, wherein the calculating means calculates the compensation for sewing shrinkage based on the sewing shrinkage parameters and the X- and Y-direction movement amounts for stitch data numbered both n and n+1.

10. The stitch data compensation device according to claim 9, wherein the calculating means calculates the compensation amount in the X-direction Hx and that in the Y-direction Hy for stitch data numbered n using the following formulas respectively:

$$Hx=(Px/4)\times\{Xn/(Xn^2+Yn^2)^{1/2}-Xn+1/(Xn+1^2+Yn+1^2)^{1/2}\}$$

$$Hy=(Py/4)\times\{Yn/(Xn^2+Yn^2)^{1/2}-Yn+1/(Xn+1^2+Yn+1^2)^{1/2}\}$$

where Hx and Hy represent compensations for sewing shrinkage in the X- and Y-directions respectively, Px and Py are parameters regarding the tendency to sewing shrinkage of the work cloth in the X- and Y-directions respectively, Xn and Yn are movement amounts in X- and Y-directions for stitch data numbered n respectively, and Xn+1 and Yn+1 are movement amounts in X- and Y-directions for stitch data numbered n+1 respectively.

11. The stitch data compensation device according to claim 10, wherein the correcting means corrects the X-direction movement amount Xn and the Y-direction movement amount Yn for stitch data numbered n using the following formulas respectively:

$$Xn\leftarrow Xn+Hx-Hxr$$

$$Yn\leftarrow Yn+Hy-Hyr$$

where Hxr and Hyr represent the previous compensation amounts in the X- and Y-directions respectively.

12. A stitch data compensation method for correcting stitch data of a movement amount of a work cloth in X- and Y-directions relative to a needle comprising the steps of:

obtaining the X- and Y-direction movement amounts for stitch data numbered n (n=natural number) respectively;

obtaining the X- and Y-direction movement amounts for stitch data numbered n+1 respectively;

calculating a compensation for sewing shrinkage in the X-direction and that in the Y-direction based on said X- and Y-direction movement amounts for stitch data both numbered n and n+1; and correcting the X- and Y-direction movement amounts for stitch data numbered n based on the compensation for sewing shrinkage respectively.

13. The stitch data compensation method according to claim 12, further comprising a step of obtaining sewing shrinkage parameters regarding a tendency toward sewing shrinkage of the work cloth, wherein the step of calculating a compensation for sewing shrinkage calculates the compensation based on the sewing shrinkage parameters, the X- and Y-direction movement amounts for stitch data numbered n and n+1.

14. The stitch data compensation method according to claim 13, wherein the step of calculating a compensation calculates a compensation amount in the X-direction Hx and that in the Y-direction Hy for stitch data numbered n using the following formulas respectively:

$$Hx=(Px/4)\times\{Xn/(Xn^2+Yn^2)^{1/2}-Xn+1/(Xn+1^2+Yn+1^2)^{1/2}\}$$

$$Hy=(Py/4)\times\{Yn/(Xn^2+Yn^2)^{1/2}-Yn+1/(Xn+1^2+Yn+1^2)^{1/2}\}$$

where Hx and Hy represent compensations for sewing shrinkage in the X- and Y-directions respectively, Px and Py are parameters regarding the tendency toward sewing shrinkage of the work cloth in the X- and Y-directions respectively, Xn and Yn are movement amounts in X- and Y-directions for stitch data numbered n respectively, and Xn+1 and Yn+1 are movement amounts in X- and Y-directions for stitch data numbered n+1 respectively.

15. The stitch data compensation method according to claim 14, wherein the step of correcting the X- and Y-direction movement amounts corrects the X-direction movement amount Xn and the Y-direction movement amount Yn for stitch data numbered n are calculated using the following formulas respectively:

$$Xn\leftarrow Xn+Hx-Hxr$$

$$Yn\leftarrow Yn+Hy-Hyr$$

where Hxr and Hyr represent the previous compensation amounts in the X- and Y-directions respectively.

16. A computer-readable storage medium that stores a program for correcting stitch data of X- and Y-movement amounts of a work cloth relative to a needle, the program comprising:

a routine to obtain the X- and Y-direction movement amounts for stitch data numbered n (n natural number) respectively;

a routine to obtain the X- and Y-direction movement amounts for stitch data numbered n+1 respectively;

a calculating routine to calculate a compensation for sewing shrinkage based on the X- and Y-direction movement amounts for stitch data both numbered n and n+1; and a correcting routine to correct the X- and Y-direction movement amounts for stitch data numbered n based on the compensation for sewing shrinkage respectively.

17. The computer-readable storage medium according to claim 16, further comprising a routine to obtain sewing shrinkage parameters regarding a tendency to sewing shrinkage of the work cloth, wherein the calculating routine calculates the compensation for sewing shrinkage based on the sewing shrinkage parameters and the X- and Y-direction movement amounts for stitch data numbered n and n+1.

18. The computer-readable storage medium according to claim 17, wherein the calculating routine calculates a compensation amount in the X-direction Hx and that in the Y-direction Hy for stitch data numbered n using the following formulas respectively:

$$Hx=(Px/4)\times\{Xn/(Xn^2+Yn^2)^{1/2}-Xn+1/(Xn+1^2+Yn+1^2)^{1/2}\}$$

$$Hy=(Py/4)\times\{Yn/(Xn^2+Yn^2)^{1/2}-Yn+1/(Xn+1^2+Yn+1^2)^{1/2}\}$$

where Hx and Hy represent compensations for sewing shrinkage in the X- and Y-directions respectively, Px and Py are parameters regarding the tendency to sewing shrinkage of the work cloth in the X- and Y-directions respectively, Xn and Yn are movement amounts in X- and Y-directions for stitch data numbered n respectively, and Xn+1 and Yn+1 are movement amounts in X- and Y-directions for stitch data numbered n+1 respectively.

19. The computer-readable storage medium according to claim 18, wherein the correcting routine corrects the X-direction movement amount Xn and the Y-direction movement amount Yn for stitch data numbered n using the following formulas respectively:

$$Xn\leftarrow Xn+Hx-Hxr$$

$$Yn\leftarrow Yn+Hy-Hyr$$

where Hxr and Hyr represent the previous compensation amounts in the X- and Y-directions respectively.

* * * * *